US005429062A

United States Patent [19]

Trabka

[11] Patent Number: 5,429,062

[45] Date of Patent: Jul. 4, 1995

[54] RAPID BAILING DEVICE

[76] Inventor: Richard J. Trabka, 65 Hillside Ave. #4H, New York, N.Y. 10040

[21] Appl. No.: 172,727

[22] Filed: Dec. 27, 1993

[51] Int. Cl.[6] ..... B63B 9/08

[52] U.S. Cl. ..... 114/121; 114/360

[58] Field of Search ..... 114/39.1, 39.2, 102, 114/103, 121, 122, 123, 124, 125, 183 R, 360, 68, 69

[56] References Cited

U.S. PATENT DOCUMENTS

| | | | |
|---|---|---|---|
| 4,001,905 | 1/1977 | Givens | 114/125 |
| 4,516,516 | 5/1985 | Methven | 114/125 |
| 4,942,839 | 7/1990 | Chuan | 114/125 |
| 5,060,591 | 10/1991 | Ciavarra | 114/125 |

*Primary Examiner*—Stephen P. Avila

*Attorney, Agent, or Firm*—Herbert Dubno; Andrew Wilford

[57] ABSTRACT

A bailing device is used with a watercraft having a hull adapted to sit in a body of water and having a deck normally above a waterline defined by the body of water and formed centrally with a cockpit. The bailing device has a pair of inflatable flexible enclosures of a volume sufficient when the enclosures are inflated to support the watercraft out of the water. The enclosures are attached to the deck above the waterline to either side of the cockpit and a tube interconnects the enclosures so that air can pass through the tube between them. The enclosures can be inflated with air while they are attached to the deck. When thus inflated with the craft in the water the watercraft can be inverted and supported on the inflated enclosures to drain water from the cockpit.

10 Claims, 3 Drawing Sheets

RAPID BAILING DEVICE

BRIEF DESCRIPTION OF THE INVENTION

Rapid bailing device is an apparatus which primary function is to assist in quick water purging from flooded small watercraft like kayaks, canoes and the like having some form of rigid deck support fore and aft.

Apparatus consists of two flexible gas enclosures generally shaped as square or rectangular, but shape is not of great importance. These two gas enclosures are connected together by means of flexible polyurethane hose which permits to balance the gas pressure in both gas enclosures whenever there is more stress applied to one of them.

The apparatus is meant to be mounted on top of the deck or any rigid surface relatively flush with the gunwales or the sides of the watercraft like bench, beam or the like placed fore and aft. Rapid bailing device has to be mounted rigidly enough to prevent it from sliding sideways off the deck when under stress and to assure proper functioning. This is accomplished with use of bronze trigger snap hooks attached to metal grommets which are fastened to the collar created on all sides of the gas enclosure or running along it's circumference; whichever shape is used.

When not in use or to create unobstructed access the device can be disengaged on one side,folded or rolled over to the other side of the deck to be secured there by strapping or other means.

The apparatus is fitted with two self locking oral inflation valves, one inlet check valve to be used with pressurized gases and two quick release valves. The device is designed to be inflated orally in short time. Additionally it is fitted with inlet check valve to permit use of compressed $CO_2$ or scuba tank. To facilitate quick oral inflation time total volume of gas enclosure is kept to necessary minimum. The device can be used on round shaped water craft in which case one gas enclosure placed in the center might be required instead of two.

Whenever watercraft becomes flooded and requires bailing particularly in strong wind or in cold water the device can be quickly unfolded if already not so and inflated by one person blowing into any of the two oral inflation valves or by two persons whenever possible, to speed up inflating. The craft is then manually rolled upside down by crew in water grabbing the opposite side of the hull or the cockpit opening and pulling up letting the boat to roll on the side next to the crew pulling. In the beginning of the maneuver the craft rolls on it's own axis. As soon as inflated gas enclosures of rapid bailing device touch the water axis on which craft rolls over shifts. Now it is located along the center axis spanning the two gas enclosures or in vicinity of it. The two inflated gas enclosures become pivoting points around whose axis the craft rolls 180 degrees. At these stage of the rolling over maneuver greater force must be applied as now the craft must be almost lifted up to be slid on top of the inflated gas enclosures so that it can rest above the water. By extending the body length out and away from the water craft just as if hiking-out on the sail boat, or by placing the body weight even further away by hanging on a leash force needed to roll the boat can be greatly reduced.

When roll-over is half completed craft floats on a Rapid Bailing Device with cockpit opening above the water, thus allowing for the remaining water to escape down by it's own gravity. Assuming the craft is free of water it can now be brought back to it's right side up position either through rolling the craft further 180 degrees by applying downward pulling or pushing force or by releasing the grip and allowing it to bounce back 180 degrees to it's correct position. Maneuver returning the craft to right side up position is easier because the boat is lighter and the resistance which was present when the boat had to be pivoted and literally lifted-up is almost null now.

Rapid Bailing Device can be also used to ease climbing into the boat. To accomplish this the aft part of the device is disengaged on the side opposite the crew and extended to the crew's side to rest on the water thus forming buoyant cushion on the crew's side. Strap attached to the side perpendicular to the craft's axis serves as stirrup into which foot is inserted gaining thus support. By grabbing the cockpit of the craft and supporting the body weight on the foot remaining in the stirrup one can swing his body into the cockpit.

RAPID BAILING DEVICE

DETAILED DESCRIPTION OF THE INVENTION

In presenting the invention and the various elements of it, the referance is made to the drawings, wherein.

Figure 1:
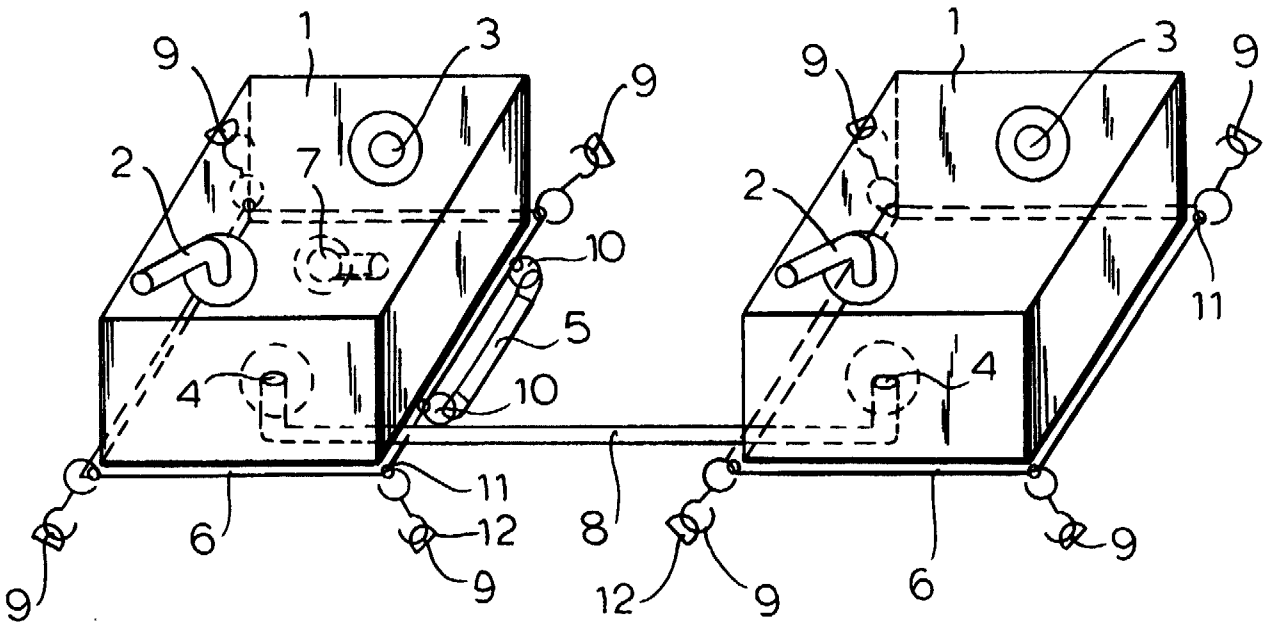
FIG. 1 is an isometric view of the novel article.
Figure 2:
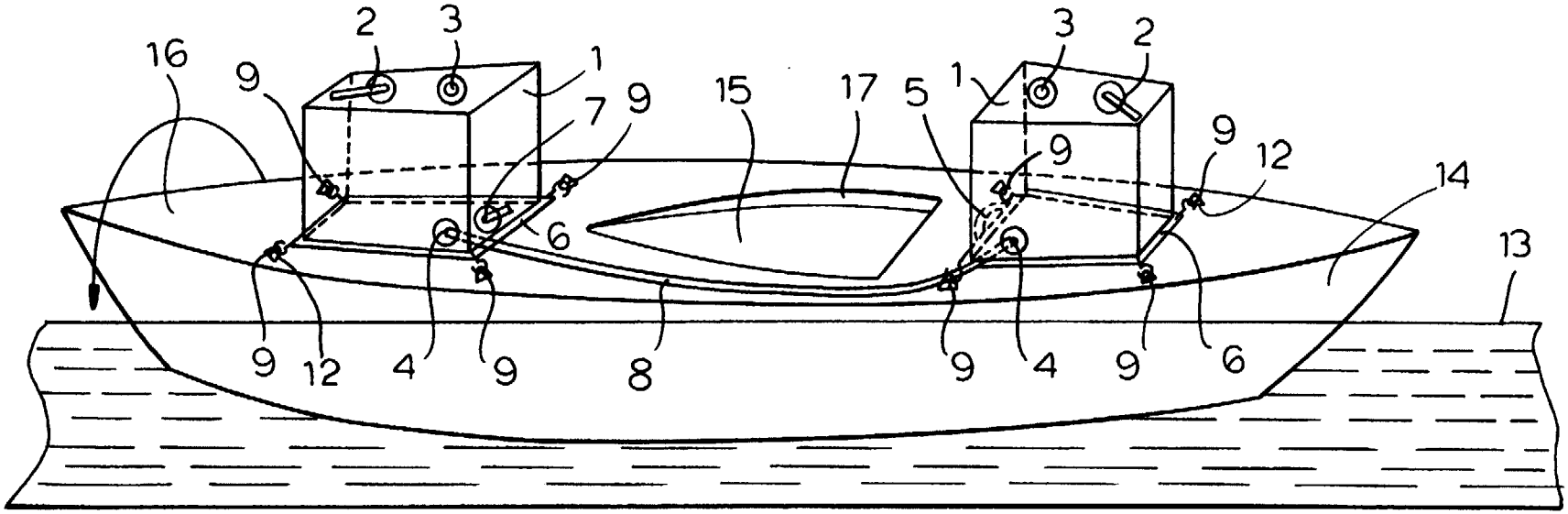
FIG. 2 is an isometric view of the novel article shown in conjunction with the object with which it is intended to be used.
Figure 3:
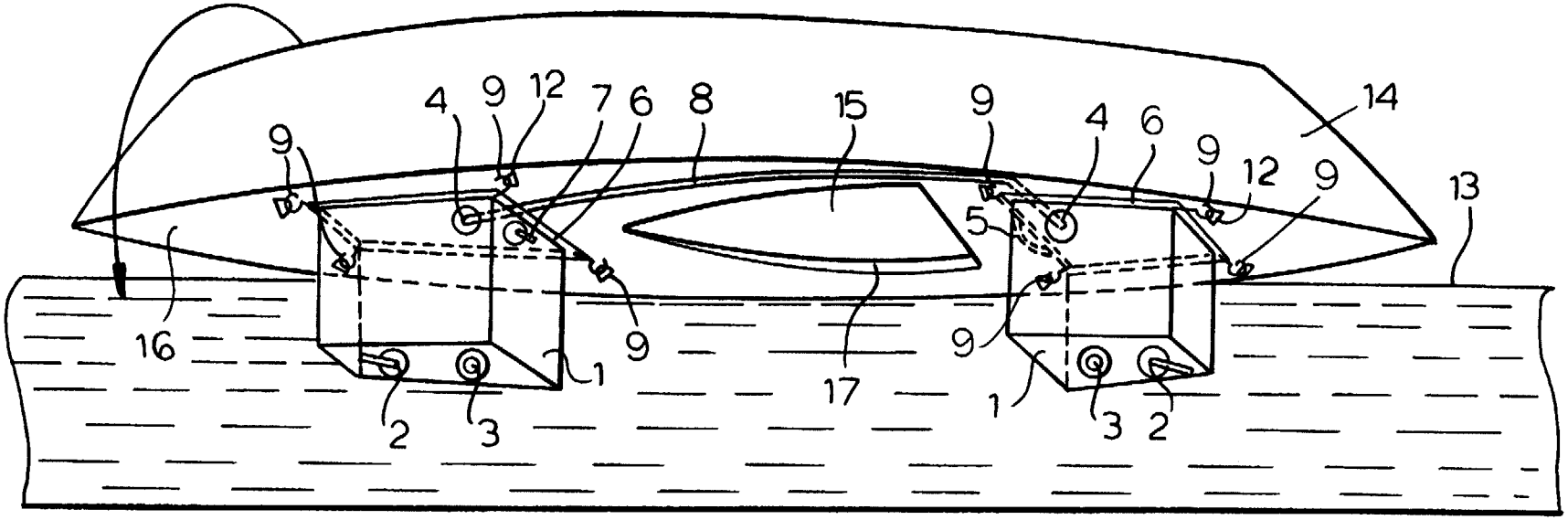
FIG. 3 is an isometric view of the novel article shown in conjunction with the object with which it is intended to be used presented in inverted position in relation to the water line.

Rapid bailing device is an apparatus designed to assist in quick water purging from flooded small watercraft like kayaks, canoes and the like which have some form of rigid deck support fore a[illegible]. The apparatus is meant to be mounted on top [illegible] deck or any rigid surface preferably flush with the port and starboard sides of the vessel so that bulk of the volume of it's gas enclosures 1 when inflated remains above the imaginary line connecting bow with stern. The apparatus has to be mounted rigidly enough to prevent it from sliding off the deck while crew attempts to roll-over the vessel and to assure proper functioning. Rigid mounting is accomplished with use marine bronze trigger snap-hooks 9 attached to metal grommets fastened to a wide collar 6 created on all sides of each gas enclosure 1 or running along it's circumference, depending on the shape of the said gas enclosures.

Apparatus consists of two flexible gas inert enclosures made from nonelastic fabric which is airtight and strong enough for this application. I've had used in my prototype 200 denier nylon coated with polyurethane. Repeated tests on the water proved this fabric to be suitable for application on small crafts such as kayaks and canoes.

Shape of these gas enclosures 1 is not of primary concern as long as they conform generally to the configuration of the deck or the like and fit to it's contours. The shape can be either square, rectangular, trapezoidal, rhomboidal, round or oval. In my prototype I've used enclosures rhomboidal in shape as this shape proved to be the most economical shape in relation to volume usage and distribution of forces creating strain in area of attachment points. The two gas enclosures 1 are connected together by means of flexible polyurethane hose 8 which permits to equalize the gas pressure in both gas enclosures 1 whenever there is more force applied to one of them or to transfer gas to the other gas enclosure when only one of them is being inflated or to cut flow of gas to one of them when needed.

The two gas enclosures 1 should be preferably mounted to the apropriate attachment points on top of the deck, which might significantly reduce the set-up time and saves the crew valuable energy. When not in use the apparatus can be disengaged on one side, folded to the other side of the deck or the like to be secured there by strap or other means provided.

The apparatus is fitted with self locking oral inflation valve 2 on each individual gas enclosure 1. Each gas enclosure 1 is fitted also with quick release valve 3. Oral inflation valve 2 and quick release valve 3 are located on top of each gas enclosure 1 for convenient access and for release valve 3 to be free from obstructions when deflating the device. The device is also fitted with one inlet check valve 7 to permit the use of compressed gases in order to speed-up the inflation time and to relieve the crew. Inlet check valve is located on the bottom of either gas enclosure 1 convenient enough to permit fast installation of $CO_2$ charge or other attachments. Nevertheless the apparatus is designed to be inflated orally in short time using approximately thirty full lung breaths. To facilitate quick oral inflation time total capacity of gas needed to fill the apparatus is kept to necessary minimum. Value of necessary was obtained through repeated testing on the water.

Whenever watercraft becomes flooded and requires bailing out of water particularly in adverse weather conditions or in cold water the two gas enclosures can be quickly unstrapped, unfolded, attached to the eyelets 12 located on the opposite side of the deck 16, and inflated by one person blowing into any of the two oral inflation valves 2 or by two crew members whenever possible. Apparatus can be also inflated instantly by jerking on the cord of inflator with $CO_2$ charge attached (optional).

Assuming the craft is filled with water and it's maneuverability is hampered, it's crew is in water the craft is then rolled upside down with it's gas enclosures 1 fully inflated. This is accomplished with crew in water on one side grabbing the opposite side of the hull 14 or the cockpit opening rim 17 and pulling up letting the vessel to roll on the side adjacent to the crew pulling. The maneuver can be accomplished from either port or star sides of the hull 14.

At the beginning of maneuver vessel rolls around it's own axis. As soon as inflated gas enclosures 1 touch the water, axis around which vessel rolls over shifts. As soon as the begins to be supported by the inflated apparatus, axis around which it rolls is located along imaginary line running through the centers of the gas enclosures 1. The said gas enclosures 1 became pivoting points around which craft rolls 180 degrees. At the early stage of rolling over when craft begins to be supported by the gas enclosures 1, greater force must be applied as the craft must be almost lifted up and it's weight with remaining water 4 within must transferred and slid on top of gas enclosures 1 so that it can rest with it's cockpit opening 15 above the water line 13.

By extending the body out and away from the vessel center line, as if hiking-out on the sailboat or by shifting the body weight even further away by hanging on a leash force needed to roll the vessel can be greatly reduced.

Part of the water escapes the craft even before the roll over is completed, because as the craft is on it's side and begins to gain support from the two gas enclosures 1 it sits higher in the water. This allows the part of the water which would otherwise stay inside to spill out. When roll over is complete craft is fully supported and floats on top of the gas enclosures 1 with enough clearance between water line 13 and it's cockpit opening 15 for the remaining water to spill down by the force of it's own gravity. Assuming the craft is free of water it can now be returned to it's right side up position, either through rolling the craft further 180 degrees by applying downward pulling force to the side adjacent to the crew or by releasing the grip and allowing it to bounce back 180 degrees. Letting the craft to bounce back is possible because whole tandem of the watercraft forming integral part together with the apparatus to which these craft is attached and on which it floats is very unstable. Tests on water prove that when the grip on the craft is released it tends fall over to either side and rights itself up.

Even if the stability of the craft floating on these gas enclosures was greater, maneuver of returning the craft to it's right side up position in the water is easier because the craft now water free is lighter and the initial resistance which had to be overcome when the craft had to be pivoted and lifted up is negligible now.

Rapid Bailing Device can also be used to ease climbing back into the boat. To accomplish this one of the gas enclosures 1 which is mounted aft of the cockpit 15 is disengaged on the side opposite the crew and extended to the crew's side to rest on the water thus forming buoyant platform. Strap 5 attached to the side perpendicular to the craft's axis and closest to the cockpit opening 15 serves as a stirrup into which foot is inserted thus gaining support. By grabbing the cockpit rim 17 and swinging the body partially supported on the leg which foot is in a stirrup 5 one can enter the craft which now free of water regained it's buoyancy and maneuverability.

I claim:

1. In combination with a watercraft having a hull adapted to sit in a body of water and having a deck normally above a waterline defined by the body of water, a bailing device comprising:

an inflatable flexible enclosure of a volume sufficient when the enclosure is inflated to support the watercraft out of the water;

means for attaching the enclosure onto the deck above the waterline and wholly out of the water; and means for inflating the enclosure with air while it is attached to the deck above the waterline and wholly out of the water, the attaching means securing the enclosure to the deck in such a position that when the enclosure is inflated with the craft in the water the watercraft can be inverted and supported on the inflated enclosure to drain water from the craft.

2. The bailing device defined in claim 1 wherein the watercraft has a cockpit opening generally centrally in the deck, the device further comprising a second inflatable flexible enclosure like the first-mentioned enclosure;

means for attaching the second enclosure to the deck above the waterline, the first and second enclosures flanking the cockpit opening; and a tube interconnecting the first and second enclosures for inflation of the second enclosure on inflation of the first enclosure.

3. The bailing device defined in claim 1 wherein the attaching means includes a plurality of attachment hooks, the deck being provided with respective eyelets to which the hooks are attached.

4. The bailing device defined in claim 3 wherein the enclosure is provided with a peripheral skirt, the hooks being spaced along the skirt.

5. The bailing device defined in claim 1 wherein the means for inflating includes an oral filling tube provided with a check valve impeding flow out the oral filling tube.

6. The bailing device defined in claim 1, further comprising a manually operable release valve on the enclosure openable to empty the enclosure of air.

7. The bailing device defined in claim 1 wherein the inflating means includes means for attachment to a compressed-gas supply, whereby a scuba tank or compressed-$CO_2$ bottle can be used to inflate the enclosure.

8. The bailing device defined in claim 1 wherein the enclosure is made of nonelastic airtight fabric.

9. The bailing device defined in claim 1 wherein when deflated the enclosure lies generally flat on the deck.

10. In combination with a watercraft having a hull adapted to sit in a body of water and having a deck normally above a waterline defined by the body of water and formed centrally with a cockpit, a bailing device comprising:

a pair of inflatable flexible enclosures of a volume sufficient when the enclosures are inflated to support the watercraft out of the water;

means for attaching the enclosures to the deck above the waterline to either side of the cockpit;

a tube interconnecting the enclosures, whereby air can pass through the tube between the enclosures;

means for inflating the enclosures with air while they are attached to the deck, whereby when the enclosures are inflated with the craft in the water the watercraft can be inverted and supported on the inflated enclosures to drain water from the cockpit.

* * * * *